US005560528A

United States Patent [19]

Chen

[11] Patent Number: 5,560,528

[45] Date of Patent: Oct. 1, 1996

[54] EXHAUST HOOD MOUNTING STRUCTURE FOR PNEUMATIC NAIL GUNS

[75] Inventor: Jacob Chen, Taichung, Taiwan

[73] Assignee: Testo Industry Corp., Taiwan

[21] Appl. No.: 439,018

[22] Filed: May 11, 1995

[51] Int. Cl.[6] ..... B25C 1/04

[52] U.S. Cl. ..... 227/130

[58] Field of Search ..... 227/130, 8

[56] References Cited

U.S. PATENT DOCUMENTS

| | | | |
|---|---|---|---|
| 3,387,541 | 6/1968 | Bade | 227/130 |
| 3,396,636 | 8/1968 | Bade | 227/130 |
| 4,117,767 | 10/1978 | Elliesen | 227/130 |
| 4,206,687 | 6/1980 | Klaus et al. | 227/130 |
| 5,476,205 | 12/1995 | Canlas et al. | 227/130 |
| 5,495,973 | 3/1996 | Ishizawa et al. | 227/130 |

*Primary Examiner*—Scott A. Smith
*Attorney, Agent, or Firm*—Donald C. Casey

[57] ABSTRACT

An exhaust hood mounting structure for pneumatic nail guns, including an exhaust hood mounted on the exhaust port of a pneumatic nail gun and having a center countersunk hole, a locating cup mounted within the center countersunk hole on the exhaust hood and having a center through hole, a screw inserted through the center through hole on the locating cup and the center countersunk hole on the exhaust hood and then threaded into a screw hole on the pneumatic nail gun within the exhaust port, wherein a corrugated spring is mounted around the screw and retained between the exhaust hood and the locating cup for permitting the exhaust hood to be turned round the screw to the desired angle by hand and retained in the adjusted position when released from hand.

1 Claim, 6 Drawing Sheets

EXHAUST HOOD MOUNTING STRUCTURE FOR PNEUMATIC NAIL GUNS

BACKGROUND OF THE INVENTION

When a pneumatic nail gun is used, the exhaust hood must be properly adjusted to prohibit exhaust air from directly blowing at the operator or at the ground in causing dust to fly about. As illustrated in FIGS. 1, 2, and 3, the exhaust hood 2 is fastened to the exhaust port 11' of the pneumatic nail gun 1' by a locating cup 22' and a screw 21'. When installed, a special tool must be used so that the screw 21' can be loosened for permitting the exhaust hood 2' to be adjusted to the desired angle. Therefore, the adjustment of the exhaust hood 2' is not easy.

SUMMARY OF THE INVENTION

The present invention has been accomplished to provide an exhaust hood mounting structure for pneumatic nail guns which eliminates the aforesaid drawback. According to the present invention, a corrugated spring washer is mounted around the screw rod between the exhaust hood and the locating cup to give a downward pressure to the exhaust hood. The spring force of the corrugated spring washer permits the exhaust hood to be directly turned round the screw to the desired angle by hand without loosening the screw or using a tool.

DETAILED DESCRIPTION OF THE PREFERRED EMBODIMENT

Figure 1:
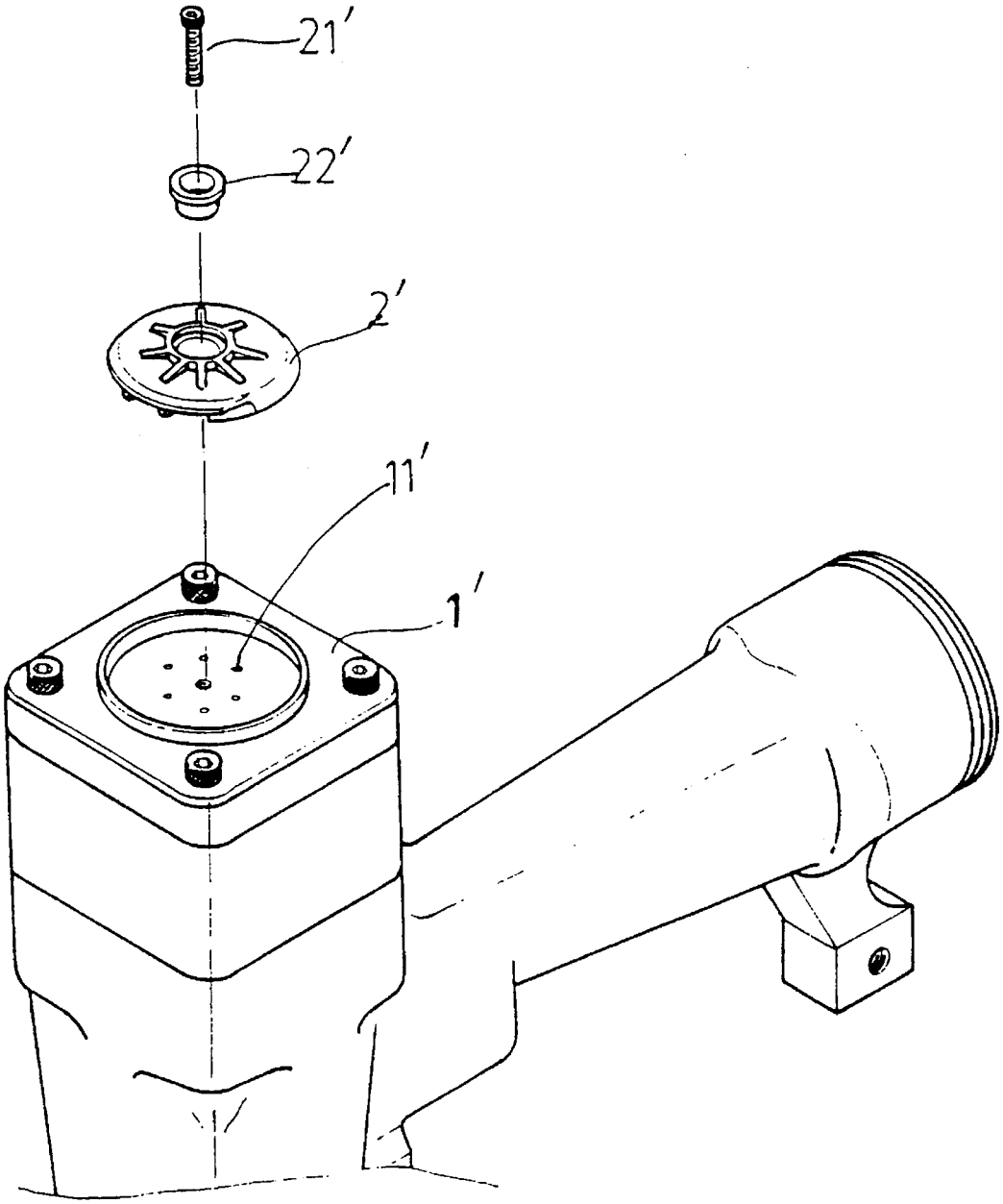
FIG.1 PRIOR ART
FIG. 1 is an exploded view of an exhaust hood mounting structure according to the prior art.
Figure 2:
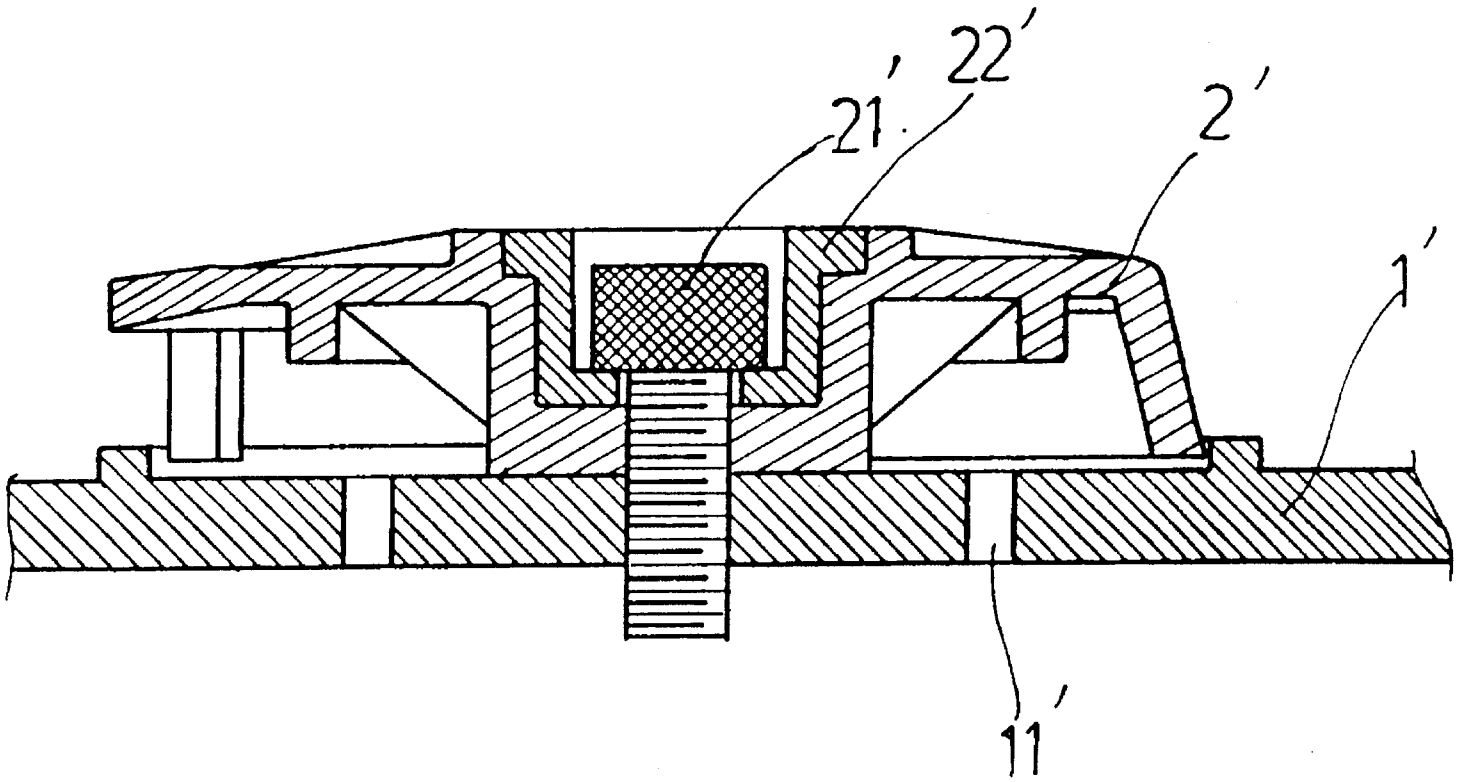
FIG. 2 PRIOR ART
FIG. 2 is an assembly view in section of the exhaust hood mounting structure shown in FIG. 1.
Figure 3:
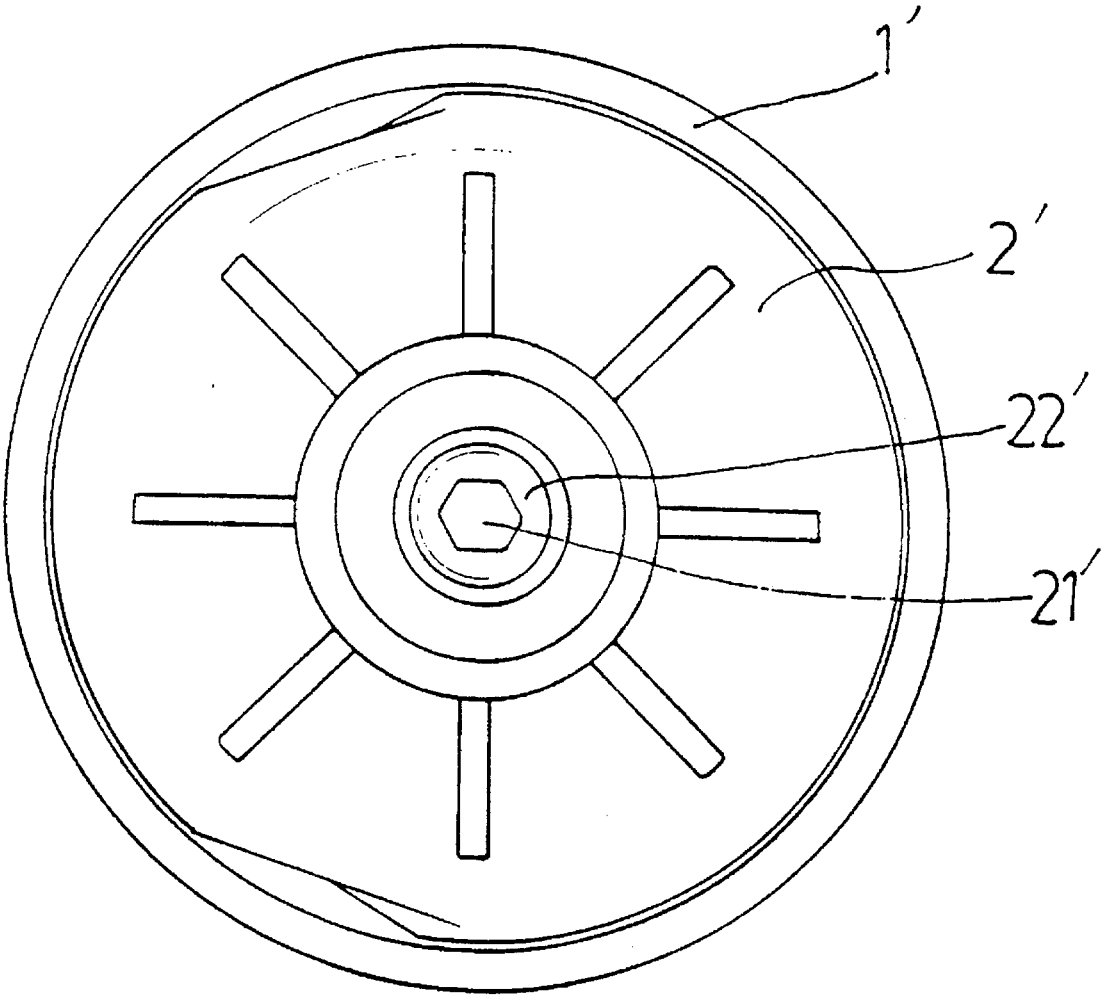
FIG. 3 PRIOR ART
FIG. 3 is a top plain view of FIG. 2.
Figure 4:
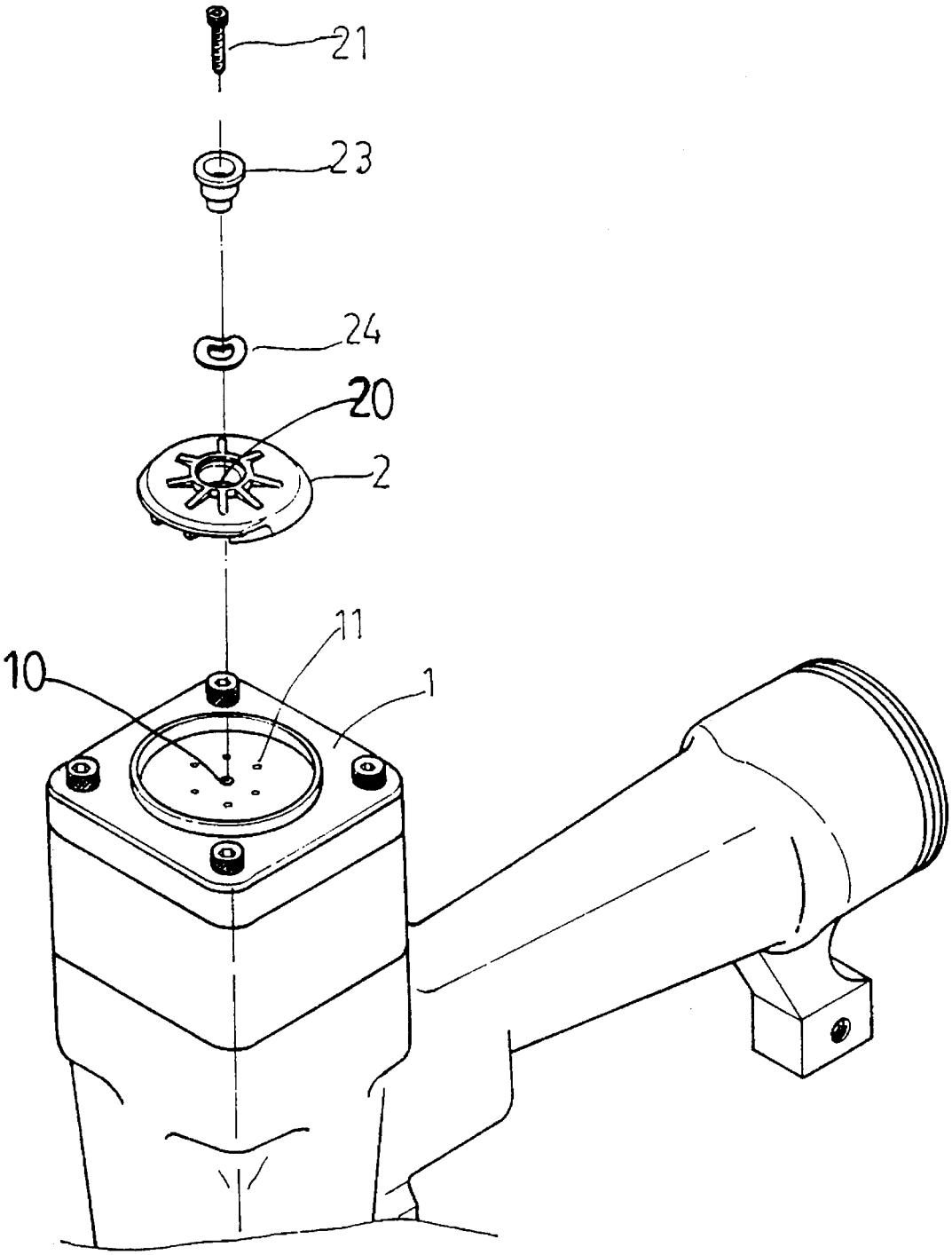
FIG. 4 is an exploded view of an exhaust hood mounting structure according to the present invention.
Figure 5:
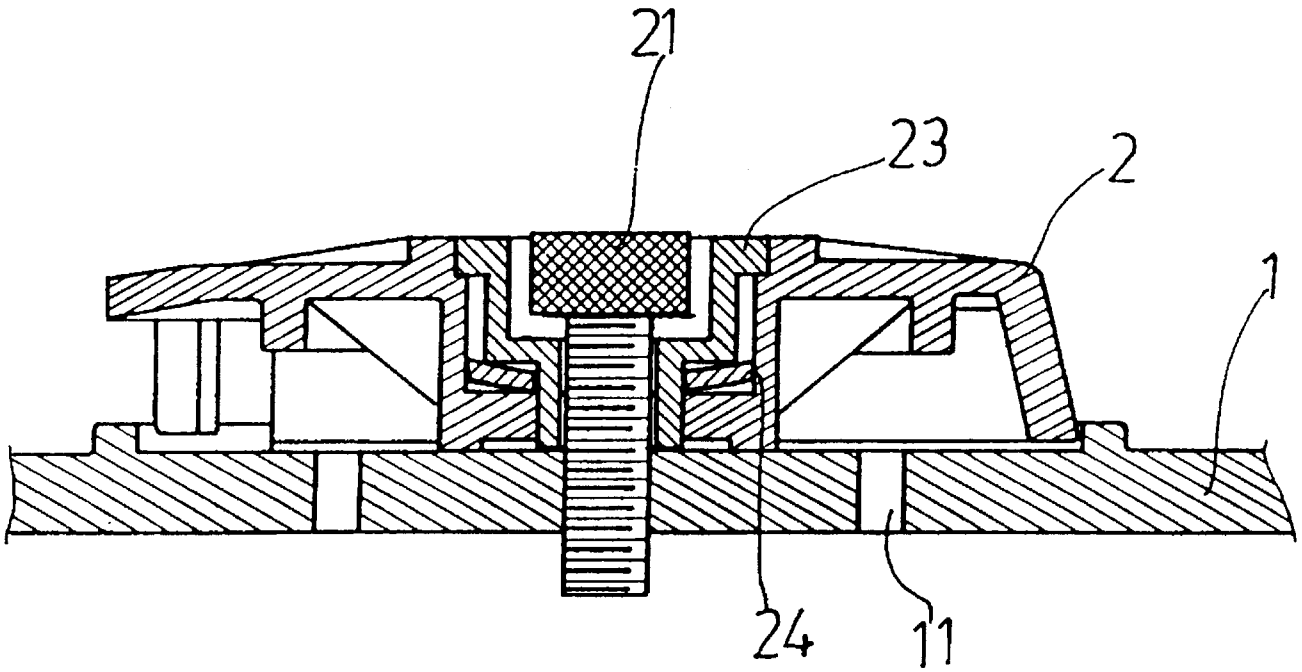
FIG. 5 is an assembly view in section of the exhaust hood mounting structure shown in FIG. 4.

Referring to FIGS. 4 and 5, an exhaust hood mounting structure for pneumatic nail gun in accordance with the present invention is generally comprised of an exhaust hood 2 mounted on the exhaust port 11 of the pneumatic nail gun, referenced by 1, a locating cup 23 mounted within the center countersunk hole 20 on the exhaust hood 2, a screw 21 inserted through a center through hole (not shown) on the locating cup 23 and the center countersunk hole 20 on the exhaust hood 2 and then threaded into a screw hole 10 on the pneumatic nail gun 1 within the exhaust port 11, and a corrugated spring 24 mounted around the screw 21 and retained between the exhaust hood 2 and the locating cup 23.

Figure 6:
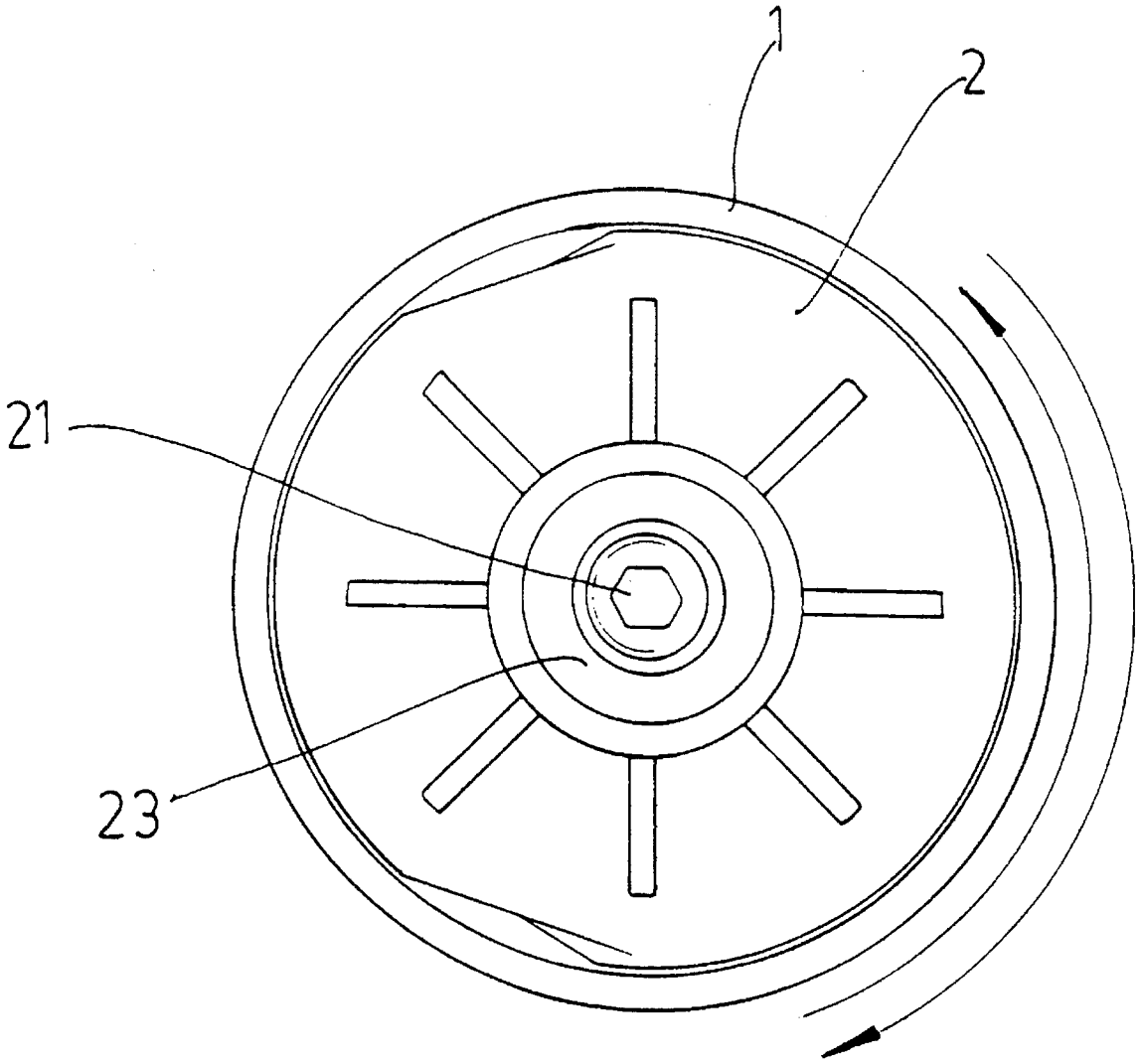
FIG. 6 is a top plain view of FIG. 5, showing the exhaust hood turn round the screw in either direction.

Referring to FIG. 6, because the corrugated spring washer 24 is mounted around the screw 21 and retained between the exhaust hood 2 and the locating cup 23, the exhaust hood 2 can be directly turned round the screw 21 to the desired angle by hand without loosening the screw 21 or using a tool. When the exhaust hood 2 is released from the hand, it immediately held down in the adjusted position by the corrugated spring washer 24.

I claim:

1. An exhaust hood mounting structure for pneumatic nail guns, comprising an exhaust hood mounted on an exhaust port of a pneumatic nail gun and having a center countersunk hole, a locating cup mounted within the center countersunk hole on said exhaust hood and having a center through hole, a screw inserted through the center through hole on said locating cup and the center countersunk hole on said exhaust hood and then threaded into a screw hole on said pneumatic nail gun within said exhaust port, wherein a corrugated spring is mounted around said screw and retained between said exhaust hood and said locating cup.

* * * * *